US008597076B2

(12) United States Patent
Krienke et al.

(10) Patent No.: US 8,597,076 B2
(45) Date of Patent: Dec. 3, 2013

(54) FLEXIBLE ENCLOSURES FOR MAINTENANCE OPERATIONS

(75) Inventors: Kenneth A. Krienke, Seattle, WA (US); Kevin H. Lee, Renton, WA (US)

(73) Assignee: The Boeing Company, Chicago, IL (US)

( * ) Notice: Subject to any disclaimer, the term of this patent is extended or adjusted under 35 U.S.C. 154(b) by 954 days.

(21) Appl. No.: 12/136,863

(22) Filed: Jun. 11, 2008

(65) Prior Publication Data

US 2009/0311954 A1 Dec. 17, 2009

(51) Int. Cl.
*B24B 1/00* (2006.01)

(52) U.S. Cl.
USPC ..... 451/38; 451/40; 451/87; 451/89; 451/90; 312/5; 312/6; 312/258

(58) Field of Classification Search
USPC ..... 451/36, 38, 39, 40, 75, 87, 89, 90, 456; 312/1, 5, 6, 258, 312
See application file for complete search history.

(56) References Cited

U.S. PATENT DOCUMENTS

| | | | | |
|---|---|---|---|---|
| 1,773,374 | A * | 8/1930 | Ruemelin | 451/88 |
| 2,321,774 | A * | 6/1943 | Ruemelin | 312/139 |
| 4,252,136 | A * | 2/1981 | Kruczynski | 135/148 |
| 4,300,318 | A * | 11/1981 | Brown | 451/88 |
| 4,787,179 | A * | 11/1988 | Lewis | 451/89 |
| 5,199,226 | A | 4/1993 | Rose | |
| 5,591,067 | A | 1/1997 | McPhee et al. | |
| 6,099,395 | A * | 8/2000 | Guseman | 451/75 |
| 6,712,677 | B2 * | 3/2004 | Williams et al. | 451/89 |
| 6,833,016 | B2 | 12/2004 | Witter | |
| 6,875,083 | B2 * | 4/2005 | Gunnell | 451/38 |
| 7,104,872 | B1 * | 9/2006 | Koch | 451/89 |
| 7,294,042 | B2 | 11/2007 | Gadd | |
| 2006/0135048 | A1 * | 6/2006 | Sommacal | 451/89 |
| 2008/0096476 | A1 * | 4/2008 | Richie | 451/89 |
| 2008/0315738 | A1 * | 12/2008 | Tan | 312/258 |

* cited by examiner

*Primary Examiner* — Eileen P. Morgan
(74) *Attorney, Agent, or Firm* — Armstrong Teasdale LLP

(57) ABSTRACT

A containment assembly is described that includes a flexible enclosure and a panel attached to the flexible enclosure. The flexible enclosure includes a first opening that defines a periphery that is operable for attachment around a work area. The panel is attached to the enclosure about a periphery defined by a second opening in the enclosure. A sealable access port is also associated with the enclosure, operable to provide a user with access to an interior of the enclosure.

23 Claims, 2 Drawing Sheets

FLEXIBLE ENCLOSURES FOR MAINTENANCE OPERATIONS

STATEMENT REGARDING FEDERALLY SPONSORED RESEARCH & DEVELOPMENT

This invention was made with Government support under contract number F33657-02-D-0009 awarded by the United States Air Force. The government has certain rights in this invention.

BACKGROUND OF THE INVENTION

The field of the invention relates generally to containment systems used for maintenance operations, and more specifically, to flexible enclosures for abrasive blasting, priming, and painting processes.

There are some systems utilized to contain and prevent the release of debris from grit blasting, starch, and/or plastic media blasting. Generally, these procedures are used for paint removal and/or shot peening operations. These operations are performed, for example, on aircraft in factories, flight line hangars or other contamination sensitive environments.

In one example, a planned structural modification of an aircraft surface incorporated a grit blast operation to be performed on the aircraft. The grit blast operation is generally performed in a contamination sensitive environment, such as near whole aircraft static test and fatigue test fixtures, and on flight test aircraft within flight line hangars. Grit blasting operations generate large quantities of airborne grit which can damage nearby aircraft and/or aircraft systems. These operations may also pose threats to the health of workers in the vicinity of these grit blasting operations.

Similarly, there are some systems and processes utilized in priming and/or painting operations to contain and prevent the release of organic vapors, overspray, fumes, fine particulates, volatile organic compounds (VOCs) or other toxic materials generated by primer/paint spraying. These operations are performed, for example, on aircraft in factories, flight line hangars or other contamination sensitive environments. Spray applied finishes are preferred in such application as they are generally of better quality than manually applied (brushed on) finishes.

Currently, temporary containment systems are used for grit blasting, priming, and painting. These containment systems are generally fabricated from rigid materials forming a frame-supported enclosure. For example, some known containment systems for grit blasting are fabricated from rigid plastic to support the attachment of gloves and air line feed-through lines. In such a system, a user inserts their hands and arms into these gloves into an interior area defined by the rigid plastic structure.

However, such a configuration has several disadvantages and limitations. For example, existing containment systems that are based on rigid enclosures, cannot be fitted to the specific shape of aircraft surfaces undergoing maintenance operations. These containment systems also cannot be positioned properly on the aircraft because they come in contact with physical obstacles near to the aircraft surfaces being worked. Also, for example, for priming and/or painting to the edge of a surface, a frame-supported enclosure needing to rest on portions of the repair field would interfere with the area to be coated. There does not appear to be a commercially available enclosure which can be adapted by the end-user, in the field at the point of use, to fit a variety of repair field sizes and shapes.

BRIEF DESCRIPTION OF THE INVENTION

In one aspect, a containment assembly is provided that includes a flexible enclosure having an opening therein that defines a periphery that is operable for attachment around a work area. The containment system also includes a panel attached to the enclosure. The panel is attached about a periphery defined by a second opening in the flexible enclosure. The containment system also includes a sealable access port formed in the enclosure that is operable to provide a user with access to an interior of the enclosure.

In another aspect, a containment system is provided that includes a flexible enclosure comprising a first opening therein, the opening defining a periphery that is operable for attachment around a work area, a panel attached to the flexible enclosure about a periphery defined by a second opening in the flexible enclosure, an air pressure source attached to the panel, an air outlet hose connector attached to the flexible enclosure about a periphery defined by a third opening in the flexible enclosure, and a vacuum source attached to the air outlet hose connector.

In still another aspect, a flexible enclosure is provided. The enclosure includes a disposable bag-like device comprising a first opening therein, where the opening defines a periphery, the periphery configured for attachment of the bag-like device to a structure such that when the bag-like device is attached to the structure, a work area on the structure is exposed to an interior of the bag-like device through the first opening. The enclosure further includes a panel attached to the bag-like device about a periphery defined by a second opening in the bag-like device, an air inlet filter assembly attached to the bag-like device about a periphery defined by a third opening in the bag-like device, an air outlet hose connector attached to the bag-like device about a periphery defined by a fourth opening in the bag-like device, and a sealable access port formed in the bag-like device that is operable to provide a user with access to the interior of the bag-like device.

In yet another aspect, a method for containing debris generated in surface treatment operations is provided. The method includes attaching a disposable bag-like device to a perimeter that is adjacent a work area, providing a controllable air flow into the bag-like device through a first opening, the first opening having an air inlet assembly mounted therein and attached to the bag-like device, providing a controllable air flow out of the bag-like device through a second opening, the second opening having an air outlet assembly mounted therein and attached to the bag-like device, and operating a tool configured to perform the work on the work area, the tool attached to a panel attached to a third opening in the bag-like device.

DETAILED DESCRIPTION OF THE INVENTION

The described embodiments disclose fabrication and use of low-cost, flexible enclosures that prevent the release of debris from grit blasting, starch blasting, and/or plastic media blasting for paint removal and/or shot peening operations and prevent the release of organic vapors, overspray, fumes, fine particulates, volatile organic compounds (VOCs) or other toxic materials generated by the spraying of primer and/or paint. As mentioned above, these operations are performed, for example, on aircraft in factories, flight line hangars, and in other contamination sensitive environments. It is to be noted however, that application of the described embodiments is not limited to the aircraft application as many industries utilize grit blasting, priming, and painting.

In one embodiment, the enclosure is a disposable, bag-like device, fabricated from polyethylene, which can be quickly tailored to fit irregular surfaces. In an embodiment, the device can be fitted with attachments that allow abrasive blast or priming/painting processes to be effectively performed inside the enclosure defined by the device, while still containing contaminating particles or hazardous organic vapors generated by the processes. In the described embodiments, the device can be utilized while still allowing tools and the operator's hands to be outside of the described enclosure.

Figure 1:
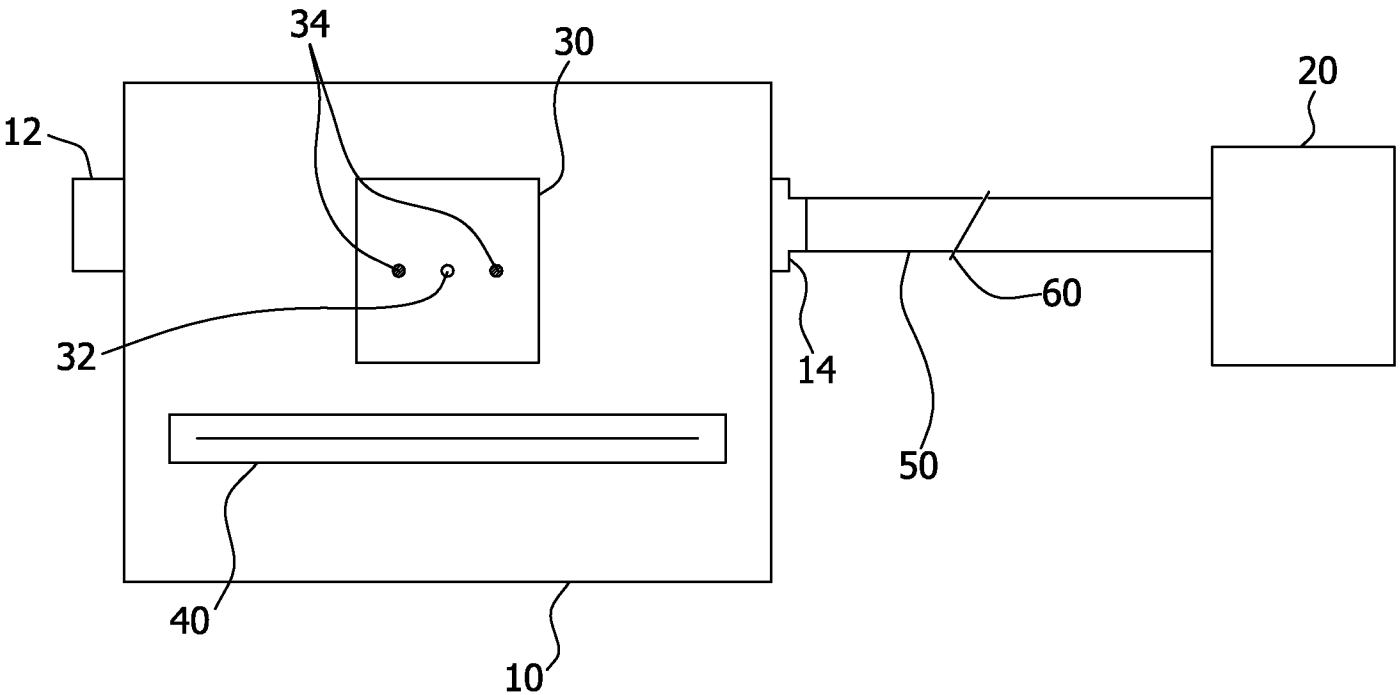
FIG. 1 is a front functional view of a frameless, flexible enclosure.

FIG. 1 is a front functional view of a frameless, flexible enclosure 10 that is made from, in one embodiment, a disposable polyethylene sheet material. As further described herein, enclosure 10 can be moved around nearby obstacles while still firmly attached to a work surface, such as an aircraft fuselage. As can be seen in FIG. 1, enclosure 10 is configured with reusable attachments, specifically, an air inlet filter assembly 12 and an air outlet hose connector 14, that allow for the further attachment of a HEPA vacuum 20 to the enclosure 10. The arrangement allows air to be pulled through the enclosure 10 during use to improve visibility.

In regards to visibility, enclosure 10 is further configured with a reusable and rigid clear panel 30, which in one specific embodiment, is taped to the enclosure 10 to provide the user with a clear view of the work surface during blasting or priming/painting operations. In a specific embodiment, panel 30 is fabricated from a clear polycarbonate. A hole 32 formed in panel 30 allows a tip of a grit blast gun (not shown) to be inside enclosure 10 during the blasting process or allows a tip of a spray gun to be inside enclosure 10 during priming and painting processes. In this embodiment, only the tip of the gun is inside the enclosure 10 during operation. The hands of the operator, and the gun, except for the tip, remain outside of the enclosure 10. When the enclosure 10 is properly attached to a work surface, the user is able to modify a shape of the enclosure and an orientation of the panel 30 with respect to the work surface. Specifically, a grit blasting gun or a paint spray gun can be used without the respective media to inflate, or expand, enclosure 10 so that is not making contact (except where attached) with the surface to be blasted or painted.

Operator comfort during use of enclosure 10 is enhanced since there is no need to have arms inserted into long rubber gloves during the blasting process, as is required with at least some conventional containment cabinets. In one specific embodiment, hole 32 is about one inch in diameter. In still another embodiment, hole 32 is centered in panel 30. In one embodiment, panel 30 is fabricated as a polycarbonate sheet window, approximately twelve inches by sixteen inches, and about ⅛ inch thick. The hole 32 is centered and about one inch in diameter to accept the tip of one commonly used grit blast gun or priming/painting spray gun.

Panel 30 is configured with, in another embodiment, a plurality of attachment point holes 34. These attachment point holes are configured as hold down points for the nozzle of the grit blast gun or the nozzle of the spray gun.

Another reusable attachment is provided on enclosure 10. Specifically, an access port 40, that can be opened and closed is provided that allows for the opening and re-sealing of the enclosure 10 as needed during the individual grit blasting, priming, and painting operations. More specifically, the access port 40, which is sometimes referred to as a zipper, can be opened to inspect the surfaces being worked, or to add or remove items from enclosure 10 between the beginning and the end of the operation. In a specific embodiment, access port 40 is fabricated from zipper material and attached about an opening formed in the flexible enclosure 10. In an alternative embodiment, access port 40 is substantially the length of enclosure 10. During primer/paint spray operations, the zipper (access port 40) is covered with tape to prevent hazardous vapors from leaking between the zipper teeth and exiting enclosure 10.

In operation, one or both of a positive air pressure and an airflow can be maintained within the enclosure 10, based on the amount of air entering enclosure 10 through the air inlet filter assembly 12 and exiting the enclosure 10 through air outlet hose connector 14. In one particular application, such as the grit blasting operation described elsewhere herein, an initial positive pressure within enclosure 10 substantially provides a certain amount of self support, while still allowing a user to move panel 30 with respect to a work area, and hence a grit blast gun or primer/paint spray gun, around a work area. When the actual grit blasting is being performed, the operator adjusts the airflow through enclosure 10 such that a portion of the positive pressure built up within the enclosure 10 is lost. In one embodiment, this is accomplished through use of a foot operated air pressure manifold as further described below. With this "negative pressure" at least a portion of the dust and particulates are drawn towards the vacuum 20, through the air outlet hose connector 14, reducing the amount of material within the enclosure, and increasing a visibility of a work surface.

In the painting application, the positive pressure substantially provides self support of the enclosure 10 as described before, so that portions of the enclosure do not come into contact with the paint application area, before or after application of the paint, while still allowing a user to move panel 30. When actually painting, there may not be an airflow through the enclosure 10. Once paint application or a portion of the paint application is completed, the airflow may be commenced, through operation of the manifold, for example, to control vapors that have collected within the enclosure 10 at a filter assembly associated with the air outlet hose connector 14. In one embodiment, this filter is an activated carbon filter. In an alternative embodiment, this filter is of the type utilized with respirators.

Such operations reduce the amount of material within the enclosure 10, and increase a visibility of a work surface. Maintaining the desired pressures is a manual function performed by the operator, through operation of the particular gun he is using, air inlet filter assembly 12 and a manifold associated with air outlet hose connector 14. The amount of positive pressure, or inflation, of enclosure 10 is adjustable by the operator to maintain a "working balance" so as to set a distance between a tip of the gun and the work surface.

In one embodiment, this positive pressure is maintained through a foot operated air pressure manifold that allows the user to control the level of pressure inside the enclosure 10, for example, during intermittent operation. In another embodiment, during a priming/painting operation, this positive pressure is maintained at a level to substantially inflate enclosure 10 to prevent the flexible enclosure material from coming in contact with the surface being coated. Enclosure 10 then remains substantially inflated after the priming/painting operation is completed until the coating dries. The compressed air also serves to help dry the coated surfaces. Such a configuration allows the user to control the amount of compressed air entering the enclosure 10 through air inlet filter assembly 12 while still allowing the HEPA vacuum 20 to run.

The air inlet filter assembly 12, in one embodiment, includes a polycarbonate plate that is attached to enclosure 10. In a particular embodiment, the polycarbonate plate is about six inches by about ten inches and about one-quarter inch thick. The plate includes two substantially evenly spaced two inch diameter holes therethrough. To these holes are attached suitable fittings, such as slotted plastic drain covers or a similar device that serves as a housing for a filter device. For example, and in one embodiment, the fittings are attached over the holes and used as housings for disposable air respirator cartridges that allow air into the enclosure 10, but prevent grit or hazardous vapors from the operations from flowing out of the enclosure 10, at least through the air inlet filter assembly 12.

In one embodiment, air outlet hose connector 14 is fabricated utilizing a polycarbonate plate and components to be attached to this plate are attachments fabricated from dust collection components of a vacuum system including a hose 50. In one specific embodiment, the polycarbonate plate is about six inches by about eight inches and about one-quarter inch thick, and includes a vacuum hose attachment mounted thereto which is configured for attachment of hose 50.

A vacuum source is created through flexible plastic hose 50 which is created through the utilization of HEPA vacuum 20. The amount of vacuum is user adjustable. Specifically, and in one embodiment, between two sections of hose 50 are situated one or more dust collection system blast gates 60 that are connected in series which are operable to create an enclosure air pressure manifold that modifies an amount of vacuum experienced within enclosure 10. In one embodiment, hose 50 is fabricated utilizing two and a quarter inch flexible vacuum hose.

Figure 2:
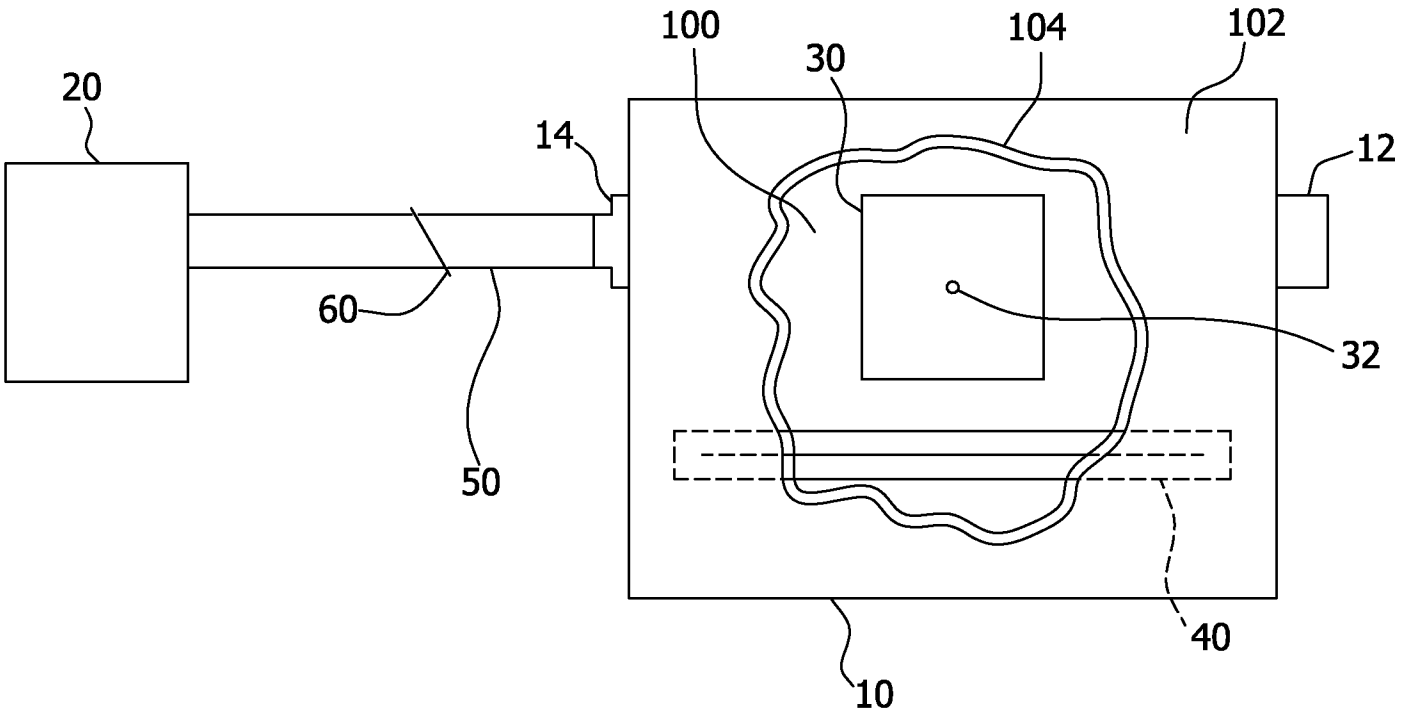
FIG. 2 is a rear view of the frameless, flexible enclosure of FIG. 1.

FIG. 2 is a rear view of the frameless, flexible enclosure 10 of FIG. 1. As can be seen in FIG. 2, enclosure 10 includes an opening 100. The opening 100 defines a perimeter on a surface 102 of the enclosure 10. Adhesives 104, including, but not limited to, tapes, putty, and other temporary adhesives are utilized to attach the enclosure 10 to a work area. The adhesives 104 ensure firm attachment of the enclosure 10 to the work surface and prevent escape of contaminating particles or hazardous vapors. In certain applications it may be desirable to have multiple incidences of adhesives 104 surrounding the opening 100.

Fabrication of enclosure 10 is fairly simple and it may be fabricated from, for example, polyethylene garbage can bags, tub skid liners, pallet covers or enclosures fabricated from rolled sheet materials such as polyethylene or nylon bagging material. When utilizing one of the above mentioned enclosures, a user simply cuts openings into the enclosure for installation of, using adhesives and the like, the air inlet filter assembly 12, the air outlet hose connector 14, the panel 30, and the access port 40 about the perimeter of the respective opening. However, in certain embodiments, enclosure 10 is fabricated to already include openings for the above listed components.

The embodiments described herein provide an advantage over existing solutions as the flexible nature of the enclosure 10 allows it to drape over or around obstacles that generally prevent attachment of rigid enclosures. In addition, the ability to tailor the footprint of the opening 100 of the flexible enclosure 10 to match the outline of the work surface avoids the use of machine or hand tools at the job site to customize poorly fitting rigid enclosures.

In use, enclosure 10 is disposed of after use while, for example, one or more of the air inlet filter assembly 12, the air outlet hose connector 14, the panel 30, and the access port 40 may be recycled for use with another enclosure 10. In other words, the portion of the enclosure system (e.g., enclosure 10) that forms the walls of the enclosure 10 is thrown away after each use and does not require cleaning or return shipment after the work has been performed. Rather, only the fittings that comprise the air inlet filter assembly 12 and the air outlet hose connector 14, the window (panel 30) and zippers (access port 40) attached to the enclosure are cut away from the plastic sheeting that forms enclosure system (e.g., enclosure 10). These recyclable components are then wiped clean and saved for re-use with the next enclosure 10.

The enclosure 10 described herein is adaptable to fit a wide variety of repair field sizes and shapes using just a few lightweight components. These components, described above, can be attached to the enclosure 10 at the point of use to place them in the most advantageous positions for each individual repair. The described features create an effective and low-cost contaminate and grit or hazardous vapor containment system.

This written description uses examples to disclose the invention, including the best mode, and also to enable any person skilled in the art to practice the invention, including fabricating and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Therefore, while the invention has been described in terms of various specific embodiments, those skilled in the art will recognize that the invention can be practiced with modification within the spirit and scope of the claims.

What is claimed is:

1. A containment assembly comprising:

a flexible enclosure comprising a first opening therein, said first opening defining a periphery that is operable for attachment around a work area, wherein said flexible enclosure is frameless and said first opening periphery is modifiable to substantially match an outline of the work area;

a panel attached to said flexible enclosure about a periphery defined by a second opening in said flexible enclosure;

a sealable access port formed in said flexible enclosure, operable to provide a user with access to an interior of said flexible enclosure;

an air outlet hose connector attached to said flexible enclosure about a periphery defined by a third opening in said flexible enclosure;

an air outlet hose connected to said air outlet hose connector;

a vacuum connected to a distal end of said air outlet hose, said air outlet hose comprising an air pressure manifold that is operable to modify an amount of pressure within said flexible enclosure, said air pressure manifold comprising at least one blast gate; and an air inlet source about a periphery defined by a fourth opening in said flexible enclosure.

2. A containment assembly according to claim 1, wherein said air inlet source further comprises an air inlet filter assembly attached to said flexible enclosure about a periphery defined by the fourth opening in said flexible enclosure.

3. A containment assembly according to claim 1 further comprising a pressure source attached to one of said panel and an air inlet filter assembly, said containment system operable to maintain a positive air pressure within said enclosure via said vacuum source and said pressure source.

4. A containment assembly according to claim 1 wherein said panel comprises a clear polycarbonate sheet comprising a hole formed therein, said hole having a size sufficient to accept at least one of a tip of a grit blast gun and a tip of a paint spray gun therethrough.

5. A containment assembly according to claim 4 wherein said panel comprises a plurality of attachment point holes formed in said panel, said holes configured for utilization as hold down points for the nozzle of at least one of the grit blast gun and the paint spray gun.

6. A containment assembly according to claim 1 wherein said flexible enclosure is fabricated from polyethylene.

7. A containment assembly according to claim 1 wherein when said flexible enclosure is properly attached to a work surface, a user is able to modify a shape of said enclosure and an orientation of said panel with respect to the work surface.

8. A containment assembly according to claim 1 wherein said access port comprises a zipper attached about an opening formed in said flexible enclosure.

9. A containment assembly according to claim 2 wherein said air inlet filter assembly comprises:

a polycarbonate plate attached to said enclosure and comprising a filter hole formed therethrough;

a filtering device; and a fitting operable to serve as a housing for said filtering device, said fitting configured for attachment to said plate about said filter hole.

10. A containment assembly according to claim 1 wherein said air outlet hose connector further comprises:

a polycarbonate plate comprising a hole formed therethrough; and a vacuum hose attachment device configured to engage said plate about said hole.

11. A containment assembly according to claim 1 further comprising an adhesive substantially adjacent the periphery about said first opening, said adhesive operable to attach said enclosure to an area adjacent the work surface.

12. A containment system comprising:

a flexible enclosure comprising a first opening therein, said first opening defining a periphery that is operable for attachment around a work area, wherein said flexible enclosure is frameless and said first opening periphery is modifiable to substantially match an outline of the work area;

a panel attached to said flexible enclosure about a periphery defined by a second opening in said flexible enclosure;

an air pressure source attached to said panel;

an air outlet hose connector attached to said flexible enclosure about a periphery defined by a third opening in said flexible enclosure;

an air outlet hose connected to said air outlet hose connector, said air outlet hose comprising an air pressure manifold that is operable to modify an amount of pressure within said flexible enclosure, said air pressure manifold comprising at least one blast gate;

a vacuum source attached to said air outlet hose, said air pressure manifold positioned between said third opening in said flexible enclosure and said vacuum source; and an air inlet source about a periphery defined by a fourth opening in said flexible enclosure.

13. A containment system according to claim 12 comprising a sealable access port formed in said enclosure, said access port operable to provide a user with access to an interior of said enclosure.

14. A containment system according to claim 12 further comprising an adhesive substantially adjacent the periphery about said first opening, said adhesive operable to attach said enclosure to the work area.

15. A containment system according to claim 12 wherein said air inlet source further comprises an air inlet filter assembly attached to said flexible enclosure about a periphery defined by the fourth opening in said flexible enclosure.

16. A flexible enclosure comprising:

a disposable, frameless bag-like device comprising a first opening therein, said opening defining a periphery, the periphery configured for attachment of said bag-like device to a structure such that when said bag-like device is attached to the structure, a work area on the structure is exposed to an interior of said bag-like device through said first opening, wherein the periphery of said first opening is modifiable to substantially match an outline of the work area;

a panel attached to said bag-like device about a periphery defined by a second opening in said bag-like device;

an air inlet source about a periphery defined by a third opening in said bag-like device;

an air inlet filter assembly attached to said bag-like device about the periphery defined by the third opening in said bag-like device;

an air outlet hose connector attached to said bag-like device about a periphery defined by a fourth opening in said bag-like device;

an air outlet hose connected to said air outlet hose connector;

a vacuum connected to a distal end of said air outlet hose, said air outlet hose comprising an air pressure manifold that is operable to modify an amount of pressure within said bag-like device, said air pressure manifold comprising at least one blast gate; and a sealable access port formed in said bag-like device that is operable to provide a user with access to the interior of said bag-like device.

17. A flexible enclosure according to claim 16 wherein said panel comprises a clear polycarbonate sheet comprising a hole formed therein, said hole having a size sufficient to accept a tip of at least one of a grit blast gun and a paint spray gun therethrough.

18. A flexible enclosure according to claim 16 wherein said air inlet filter assembly comprises:

a polycarbonate plate attached to said bag-like device and comprising a filter hole formed therethrough;

a filtering device; and a fitting operable to serve as a housing for said filtering device, said fitting configured for attachment to said plate about said filter hole.

19. A flexible enclosure according to claim 16 wherein said air outlet hose connector comprises:

a polycarbonate plate attached to said bag-like device and comprising a hole formed therethrough; and a vacuum hose attachment device configured to engage said plate about said hole.

20. A flexible enclosure according to claim 16 further comprising an adhesive substantially adjacent the periphery about said first opening, said adhesive operable to attach said bag-like device to the work area.

21. A method for containing debris generated in surface treatment operations, said method comprising:

attaching a disposable, frameless bag-like device to a perimeter that is adjacent a work area, wherein the disposable bag-like device includes a first opening defining a periphery that is modifiable to substantially match an outline of the perimeter;

providing a controllable air flow into the bag-like device through a second opening, the second opening having an air inlet assembly mounted therein and attached to the bag-like device;

providing a controllable air flow out of the bag-like device through a third opening, the third opening having an air outlet assembly mounted therein and attached to the bag-like device;

providing a vacuum connected to a distal end of the air outlet assembly;

operating a tool configured to perform the work on the work area, the tool attached to a panel attached to a fourth opening in the bag-like device; and operating an air pressure manifold to modify an amount of pressure within the bag-like device, the air pressure manifold positioned between the bag-like device and the vacuum, the air pressure manifold comprising at least one blast gate.

22. A method according to claim 21 wherein attaching a disposable bag-like device to a perimeter that is adjacent a work area comprises attaching an air inlet filter assembly to the bag-like device about a periphery defined by the second opening in the bag-like device adjacent the work area such that the work area is exposed to an interior of the bag-like device through the second opening.

23. A method according to claim 21 further comprising forming a sealable access port in the bag-like device that is operable to provide a user with access to the interior of the bag-like device.

* * * * *